United States Patent [19]

Steiger et al.

[11] 4,326,021

[45] Apr. 20, 1982

[54] PHOTOGRAPHIC NEGATIVE MATERIAL WITH AT LEAST ONE LAYER CONTAINING A DESENSITIZED SILVER HALIDE EMULSION

[75] Inventors: Rolf Steiger, Praroman; Jean-Francois Reber, Marly, both of Switzerland

[73] Assignee: Ciba Geigy AG, Basel, Switzerland

[21] Appl. No.: 233,411

[22] Filed: Feb. 11, 1981

[30] Foreign Application Priority Data

Mar. 7, 1980 [CH] Switzerland ..... 1819/80

[51] Int. Cl.[3] ..... G03C 1/36

[52] U.S. Cl. ..... 430/427; 430/401; 430/428; 430/430; 430/434; 430/606; 430/578

[58] Field of Search ..... 430/606, 578, 401, 428, 430/430, 434, 427

[56] References Cited

U.S. PATENT DOCUMENTS 2,282,115 5/1942 Brooker et al. ..... 430/578

OTHER PUBLICATIONS

Tamura et al.: On the Desensitization of Silver Halide Emulsion by Dyes, Photo. Science and Engr., vol. 11, No. 2, Mar.-Apr. 1967, pp. 82-92.

*Primary Examiner*—Won H. Loite, Jr.

*Attorney, Agent, or Firm*—Sprung, Felfe, Horn, Lynch & Kramer

[57] ABSTRACT

Photographic negative material which has at least one layer which contains a desensitized silver halide emulsion, the desensitizer used being a trinuclear heptamethinecyanine or a halogenated trinuclear tetramethinecyanine which has three identical heterocyclic ring systems, which can have different substituents and are linked to one another by three identical methine systems, which can be mesomeric, is suitable for processing in subdued daylight but nevertheless has an adequate sensitivity on exposure to intense light.

11 Claims, No Drawings

PHOTOGRAPHIC NEGATIVE MATERIAL WITH AT LEAST ONE LAYER CONTAINING A DESENSITIZED SILVER HALIDE EMULSION

The present invention relates to a photographic negative material with at least one light-sensitive layer which contains a desensitised silver halide emulsion of the negative emulsion type.

It is known that negative-working silver halide emulsions can be desensitised by certain categories of compounds. In general, these substances lower the sensitivity by an amount which is greater than logE = 1.0 but is rarely more than logE = 3.0. Examples of conventional desensitisers are phenosafranin, pinakryptol yellow, certain bispyridinium salts and also the substances described in U.S. Pat. Nos. 3,501,310 and 3,501,311. The use of desensitisers in negative-working photographic silver halide materials has been described in a number of patent specifications, for example in British Patent Specification No. 946,476 or in U.S. Pat. Nos. 3,326,687, 3,579,333, 3,628,958 and 3,671,254.

One important application of desensitised silver halide emulsions relates to films for the graphic trade and for the reproduction of technical drawings. In this field it is frequently advantageous to possess a photographic material which can be handled under bright yellow light or even in daylight, which is subdued if necessary. For applications of this type, in general, preferred emulsions are those which are desensitised by a factor logE of more than 2.5 and in paritcular those which have a particularly high low-intensity reciprocity error, i.e. materials which under relatively weak illumination have a considerably lower sensitivity than under high light intensities such as can be produced, for example, with gas discharge lamps or halogen lamps.

The object of the present invention is to prepare novel photographic materials, for example photographic materials which are stable in lit working rooms, which materials, because of the presence of at least one desensitised silver halide emulsion layer, can be processed in subdued daylight and nevertheless have adequate sensitivity on exposure to intense light.

It has been found that certain categories of trinuclear cyanines, in particular trinuclear heptamethinecyanines, and also halogenated trinuclear tetramethinecyanines, are highly effective desensitisers with which it is possible to achieve, in general, desensitisation factors logE of 2.5 to 6 and in special cases even higher.

The present invention therefore relates to a photographic negative material with at least one layer which contains a desensitised silver halide emulsion, wherein this layer contains, as the desensitiser, a trinuclear heptamethinecyanine or a halogenated trinuclear tetramethinecyanine with three identical heterocyclic ring systems, which can have different substituents and are linked to one another by three identical methine systems, which can be mesomeric.

The invention also relates to the process for the preparation of the photographic material, the process for the production of photographic images using the photographic materials according to the invention and also the use of the trinuclear cyanines as desensitisers in photographic, negative-working materials.

Suitable trinuclear cyanine dyes have already been described, in particular for use in photographic direct-positive materials which work on the surface-fogging principle. (German Offenlegungsschrift No. 2,935,333, European Offenlegungsschrift No. 22,753.)

Trinuclear cyanine dyes which can be used for the present invention have, for example, the formulae

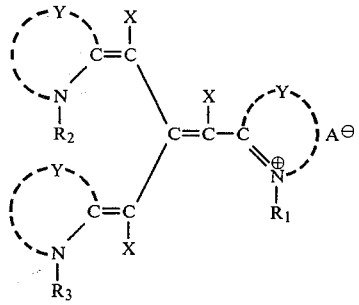

(1)

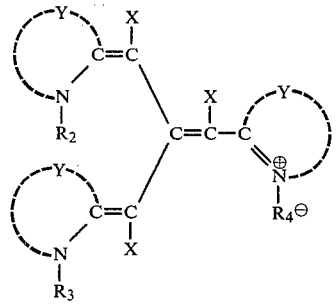

(2)

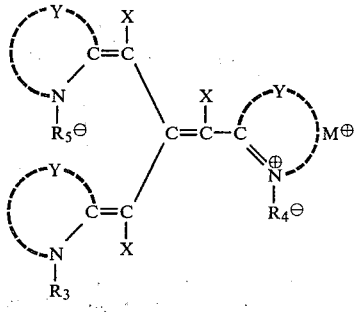

(3)

or

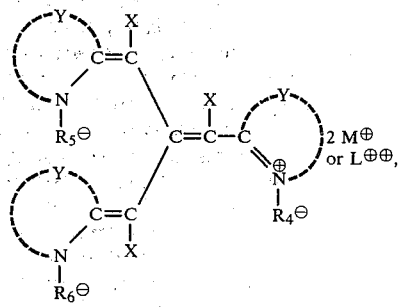

(4)

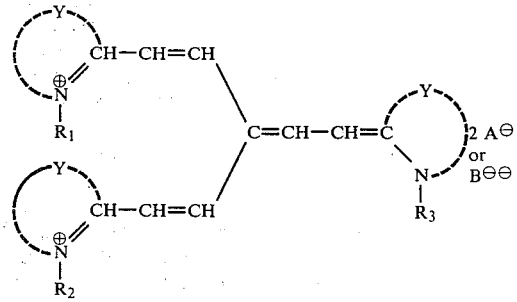

(5)

-continued (6)

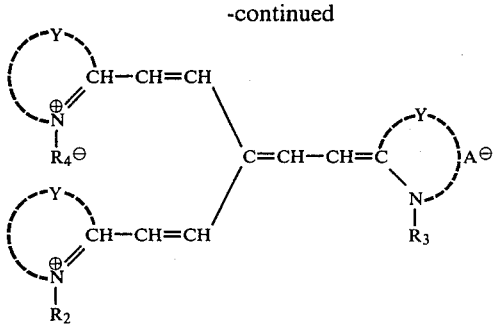

(7)

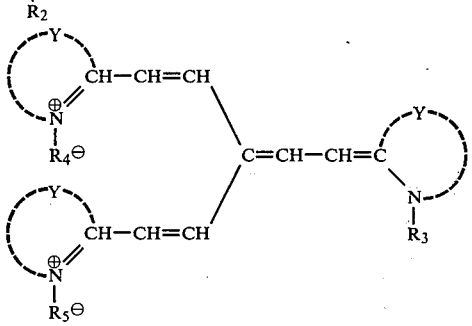

or (8)

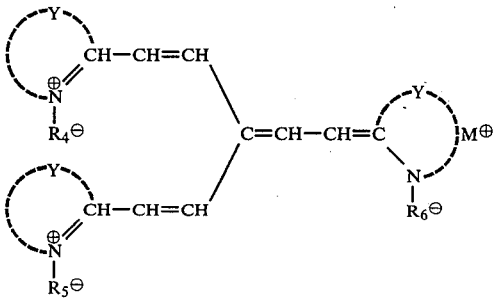

in which Y is the atoms required to complete a mono- or poly-heterocyclic ring system, $R_1$, $R_2$ and $R_3$ are each alkyl having 1 to 20 carbon atoms or alkenyl having 2 to 20 carbon atoms, preferably alkyl or alkenyl having 1 (2) to 4 carbon atoms in the main chain, the said radicals being unsubstituted or substituted by halogen, hydroxyl, cyano, alkoxy having 1 to 4 carbon atoms or carbalkoxy having 1 to 4 carbon atoms in the alkoxy radical, or are each aryl or aralkyl, which are unsubstituted or substituted by halogen, hydroxyl, cyano, alkoxy having 1 to 4 carbon atoms, carbalkoxy having 1 to 4 carbon atoms in the alkoxy radical, alkyl, hydroxyalkyl or halogenoalkyl having 1 to 4 carbon atoms, or mono- or di-alkylamino, amino, carboxamido or sulfonamido groups, $R_4$, $R_5$ and $R_6$ are each alkyl or alkenyl having 1 (2) to 20 carbon atoms, aryl, preferably phenyl, or aralkyl, preferably benzyl or phenylethyl, which are substituted by a carboxyl or sulfo group, X is hydrogen, fluorine, chlorine, bromine or iodine, at least one radical X being halogen, $A^{\ominus}$ is a monovalent anion and $M^{\oplus}$ is a monovalent cation, $L^{\oplus\oplus}$ is a divalent cation and $B^{\ominus\ominus}$ is a divalent anion.

Suitable substituents on the said alkyl or alkenyl radicals ($R_1$, $R_2$ and $R_3$), which preferably contain 1 (2) to 4 carbon atoms, are, for example, halogen (fluorine, chlorine or bromine), hydroxyl, cyano, alkoxy having 1 to 4 carbon atoms and carbalkoxy having 1 to 4 carbon atoms in the alkoxy radical; suitable substituents on the aryl and aralkyl, which in particular are phenyl or phenylethyl, are the same substituents, and also alkyl, hydroxyalkyl or halogenoalkyl, each having 1 to 4 carbon atoms, and $-NH_2$, $-CONH_2$ or $-SO_2NH_2$, which can also be substituted on the nitrogen atom by alkyl ($C_1$–$C_4$).

$R_4$, $R_5$ and $R_6$, which can be identical or different, are alkyl or alkenyl, aryl or aralkyl which are substituted by carboxyl (—COOH or $-COO^{\ominus}$) or the sulfo group ($-SO_3H$ or $-SO_3^{\ominus}$) and in which alkyl or alkenyl contain, for example, not more than 4 carbon atoms and aryl or aralkyl is preferably phenyl, benzyl or phenyl ethyl.

Preferred substituents $R_1$ to $R_3$ are methyl, ethyl, n-propyl, n-butyl, iso-butyl, allyl, β-methallyl, β-methoxyethyl, β-ethoxyethyl, β-hydroxyethyl, γ-hydroxypropyl, phenyl, benzyl or β-phenylethyl.

Preferred substituents $R_4$ to $R_6$ are carboxymethyl, carboxyethyl, carboxypropyl, carboxybutyl, sulfoethyl, sulfopropyl, sulfobutyl, p-sulfobenzyl, carbomethoxymethyl or -ethyl or carboethoxy-methyl or -ethyl.

Suitable mono- or poly-cyclic heterocyclic ring systems are, in particular, those containing 1 to 4, preferably fused, rings, at least one ring of which is heterocyclic. Ring systems containing 5-membered and/or 6-membered rings are preferred.

Optionally, they can contain further substituents (in addition to $R_1$, $R_2$, $R_3$, $R_4$, $R_5$ and $R_6$), for example alkyl ($C_1$–$C_4$), in particular methyl, aryl, in particular phenyl, or halogenoalkyl ($C_1$–$C_4$), in particular trifluoromethyl.

Preferred heterocyclic ring systems are indicated by the formulae given below. For reasons of simplicity, in each case only one mesomeric structure is indicated. R has the meanings defined for $R_1$ to $R_6$.

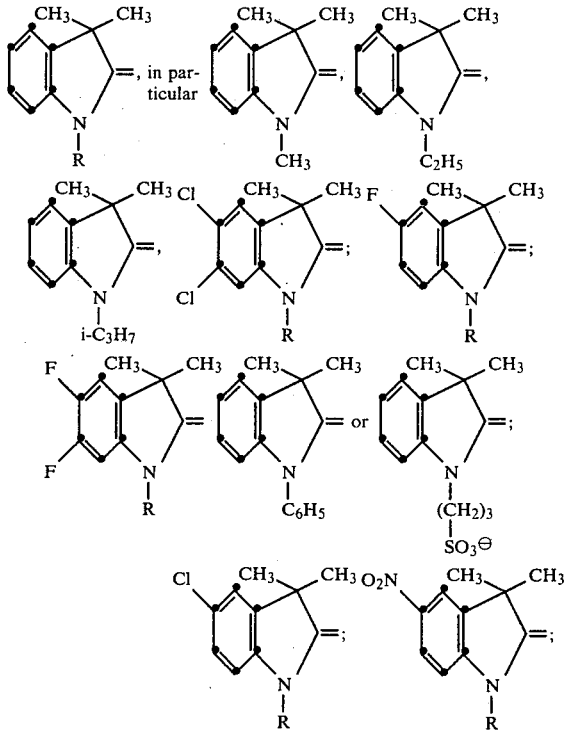

-continued
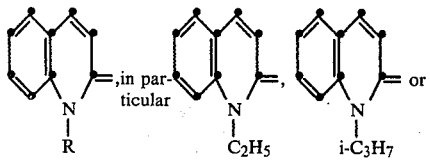
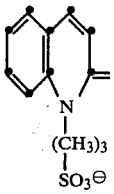
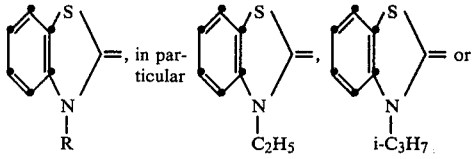
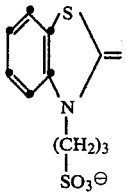
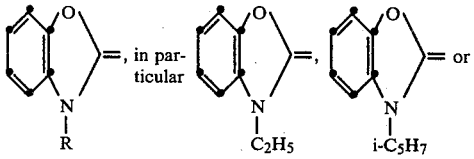
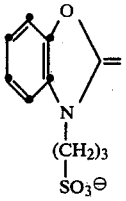
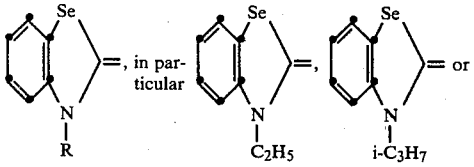
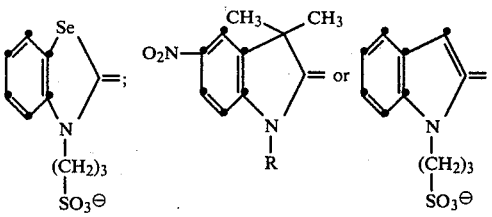
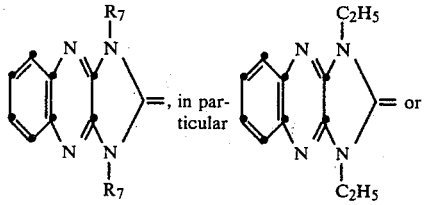
-continued
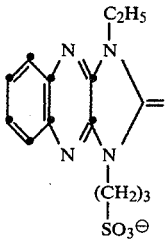
($R_7$ = alkyl having 1 to 4 carbon atoms)
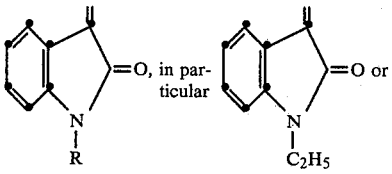
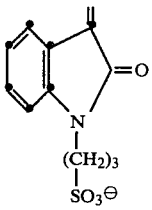
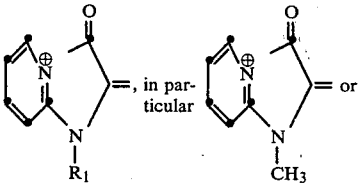
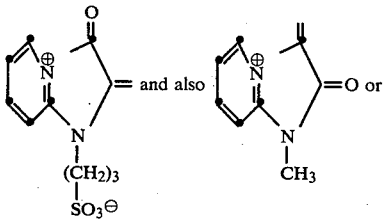
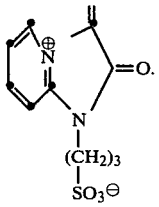
Further suitable heterocyclic radicals have the following formulae:
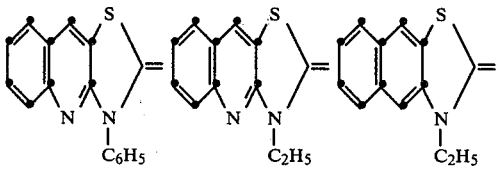

-continued
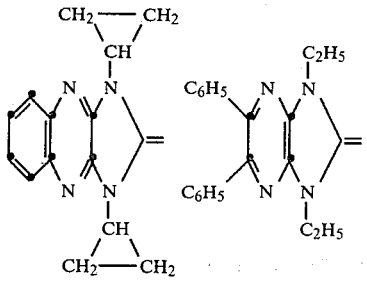
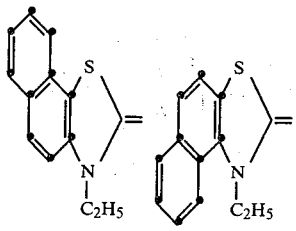
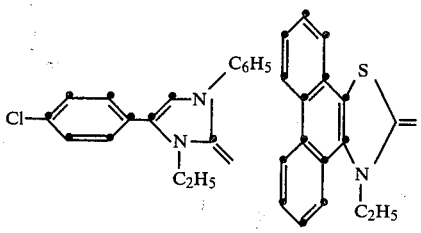
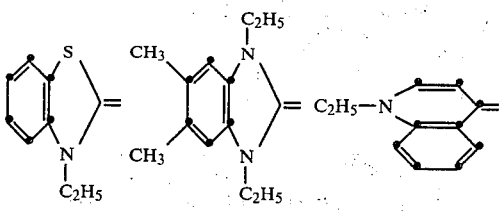
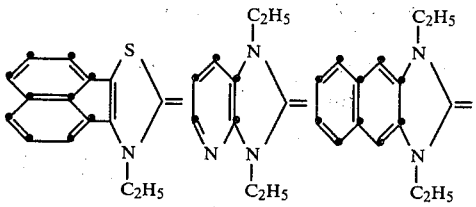
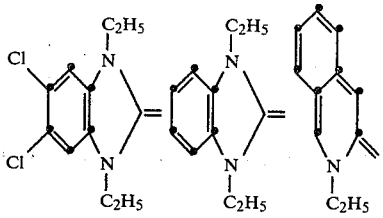
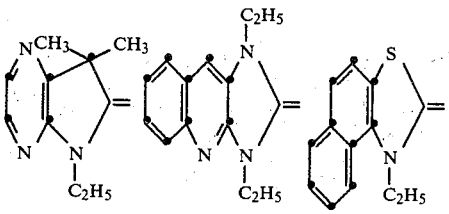
-continued
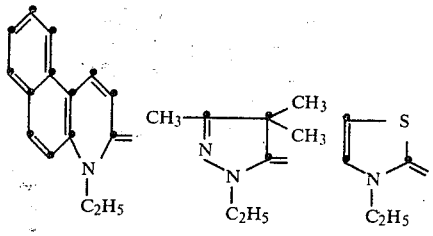
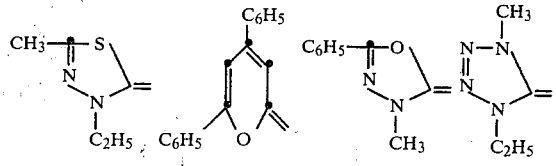
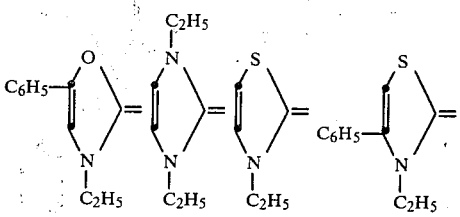
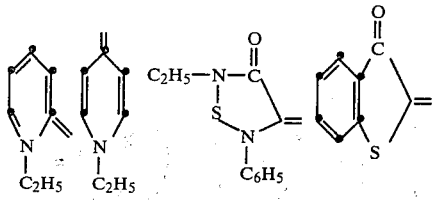
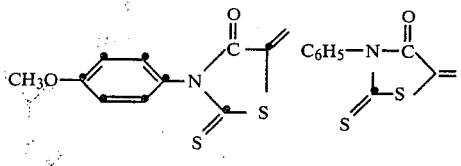
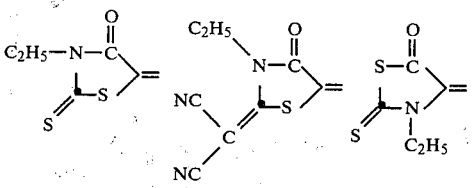
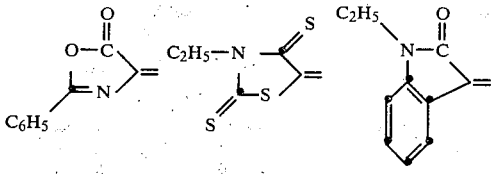
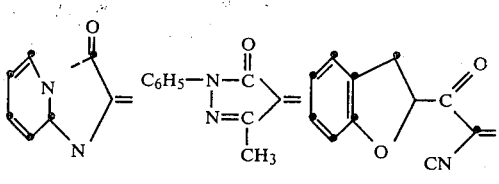
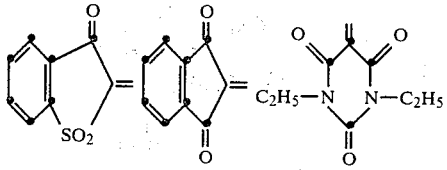

-continued

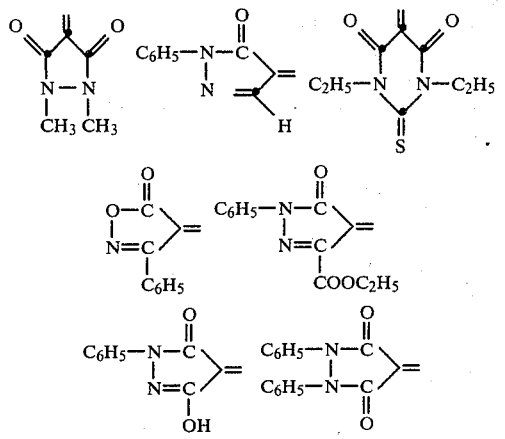

The abovementioned heterocyclic radicals with betaine structures, for example $-(CH_2)_n-COO^{\ominus}$ or $-(CH_2)_nSO_3^{\ominus}$ substituents on a nitrogen atom, are also suitable (n=1–4).

The heterocyclic compounds which are suitable for the preparation of cyanine dyes are known, for example, from D. M. Sturmer, Syntheses and Properties of Cyanine and Related Dyes in Chemistry of Heterocyclic Compounds, Volume 30 (1977), edited by A. Weissberger and E. C. Taylor.

Suitable anions $A^{\ominus}$ in the compounds of the formulae (1), (5) and (6) are, in particular, the halides, such as chloride, bromide or iodide, and also nitrate, tetrafluoborate, perchlorate, thiocyanate and p-toluenesulfonate, as well as hydrogen sulfate. Divalent anions are, for example, $SO_4^{\ominus\ominus}$, $CO_3^{\ominus\ominus}$, $-HPO_3^{\ominus\ominus}$ and the like.

The monovalent cations $M^{\oplus}$ in the compounds of the formulae (3), (4) and (8) are, for example, hydrogen, alkali metals (sodium or potassium), ammonium or, optionally substituted ammonium. Divalent cations are, for example, magnesium ions and other alkaline earth metal ions.

The synthesis and properties of trinuclear, but not halogenated, cyanine dyes are described in C. Reichhardt and W. Mormann, Chem. Ber. 105, 1815 (1972); C. Reichhardt and K. Halbritter, Chem. Ber. 104, 822 (1971); F. Baer and H. Oehling, Org. Magnet. Resonance 6, 421 (1974); and C. Reichhardt, Tetrahedron Letters 1967, 4327.

The halogenated trinuclear tetramethinecyanine dyes used according to the invention are obtained from known cyanine dyes by halogenation with conventional halogenating agents. Suitable halogenating agents, which are employed in alcohol solutions (methanol or ethanol), which can contain water, are, for example, elementary halogens, such as fluorine, chlorine, bromine or iodine, and also N-chlorosuccinimide, N-bromosuccinimide, N-iodosuccinimide or halogen/pyrrolidone complexes; and also N-chlorobenztriazole and iodine chloride.

Particularly preferred trinuclear heptamethinecyanine dyes and halogenated trinuclear tetramethinecyanine dyes have the formulae (9)

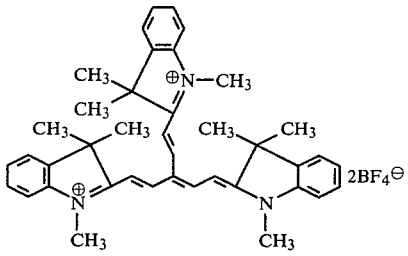

(10)

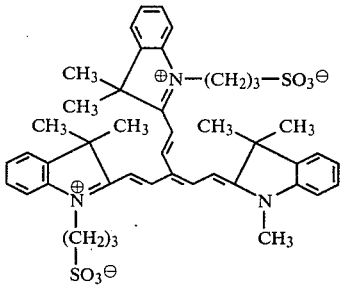

(11)

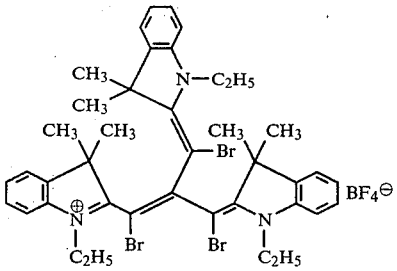

(12)

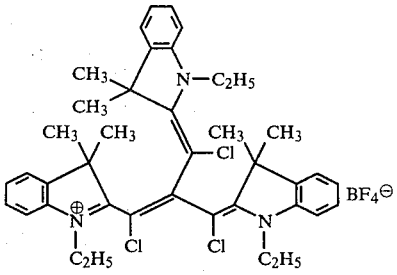

(13)

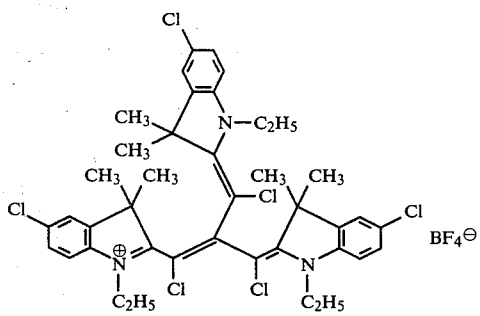

and

-continued (14)

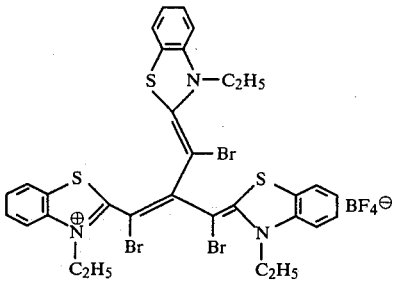

The desensitisers can be present in the silver halide emulsions in very diverse concentrations. As a rule, they are used in concentrations such that a desensitisation log E of more than 2.5 (up to 6.0) is achieved.

The maximum amount should be so chosen that the silver halide emulsion is not adversely affected. As a rule, up to about 1,000 and preferably up to 500 mg of desensitiser can be employed per mol of silver halide. The minimum amount of desensitiser, which suffices for a densensitisation of more than 2.5 log E, is about 15–30 mg per mol of silver halide.

After 10 minutes exposure to light (yellow light) with an intensity of 100 lux and subsequent silver developing, the photographic materials according to the invention—when used, for example, as material which is stable in lit working rooms—has a density of less than 0.1.

The silver halide emulsions used to prepare the photographic material according to the invention can contain, for example, silver bromide, silver iodide, silver chloride, silver chloride/silver bromide, silver iodide/silver bromide and silver chloride/silver iodide/silver bromide. Emulsions which contain only silver chloride are not suitable. Good results are also obtained when at least one photographic emulsion layer which contains silver chloride/silver iodide, silver iodide/silver bromide or silver chloride/silver iodide/silver bromide with an iodine content of, for example, 1 to 20 mol % is used. The emulsions can be conventional negative emulsions. The emulsions can contain the conventional additives, for example hardeners, sensitisers, stabilisers, wetting agents, plasticisers, brighteners and anti-fog agents.

The binder used for the photographic layers is preferably gelatin. However, this can be wholly or partly replaced by other naturally occurring binders, for example alginic acid and its derivatives, such as salts, esters or amides, cellulose derivatives, such as carboxymethylcellulose, an alkylcellulose, such as hydroxyethylcellulose, or starch and its derivatives, such as ethers or esters, are suitable. Synthetic binders which can be used are, for example, acrylic resins, polyvinyl alcohol, partially saponified polyvinyl acetate or polyvinylpyrrolidone. Emulsion supports for the photographic material according to the invention are the films which are customary and suitable for this purpose, for example films of cellulose nitrate, cellulose acetate, such as cellulose triacetate, polystyrene, polyesters, such as polyethylene terephthalate, polyolefines, such as polyethylene or polypropylene, and also uncoated or coated papers, for example polyethylene-coated papers, and also glass.

The desensitisers used according to the invention can be incorporated into the photographic emulsions by conventional methods, for example by adding them to the emulsions in the form of a solution in alcohols, especially trifluoroethanol and methanol or also dimethylsulfoxide.

In addition to the light-sensitive layer or layers, the photographic materials can also contain further layers, such as protective layers, filter layers, antihalation layers and also layers containing further constituents which affect the image, such as colour couplers or bleachable dyes.

Processing (developing, bleaching and fixing) is likewise effected by conventional methods. The emulsions desensitised with the trinuclear cyanines used according to the invention have the desired reciprocity error and are therefore considerably less sensitive on exposure to illumination of low intensity than on exposure to illumination of high intensity. They are therefore outstandingly suitable for the preparation of photographic materials which can still be handled without hazard in subdued daylight but still possess an adequate sensitivity under the normal conditions of use, for example on flash exposure.

In the examples which follow parts and percentages are by weight unless indicated otherwise.

EXAMPLE 1

A cubic-monodisperse silver iodide/silver bromide emulsion in which the crystals have a mean edge length of 0.28$\mu$ and which contains 1.6 mol percent of silver iodide is subjected to gold-sulfur ripening for 90 minutes at 54° C., a pH value of 6.8 and a pAg value of 8.1 being maintained during this step.

The emulsion thus obtained is divided into 14 equal parts, to which, in accordance with Table 1, various methanolic solutions of the desensitiser of the formula (9) are added. The emulsions treated in this way are each adjusted to a pH value of 6.0 and a pAg value of 8.4 and are then coated onto a polyester base, in a layer thickness corresponding to 2.3 g of silver and 3.2 g of gelatin per m$^2$. After drying, the samples are exposed for 20 seconds behind a step wedge using a conventional tungsten filament lamp with an intensity of 500 lux and are then developed using a developer solution of the following composition.

| | |
|---|---|
| N-methyl-p-aminophenol sulfate | 2.0 g |
| Anhydrous sodium sulfite | 75.0 g |
| Hydroquinone | 8.0 g |
| Anhydrous sodium carbonate | 37.5 g |
| Potassim bromide | 2.0 g |
| Water to make up to | 3,000 ml |

Evaluation of the exposed and developed step wedges gives the sensitometric values given in Table 1. From the table it can clearly be seen that the cyanine of the formula (9) has a highly desensitising effect which, within the range investigated, increases in intensity in parallel with the amount added.

TABLE 1

| Sample No. | Desensitiser Compound No. | Desensitiser (mg/mol of AgBr) | Sensitivity $S_{50}$* | Contrast $\gamma$ | $D_{min}$ |
|---|---|---|---|---|---|
| 1 | | — | 2.50 | 2.5 | 0.02 |
| 2 | | 1.3 | 2.25 | 2.9 | 0.04 |
| 3 | | 3.3 | 1.98 | 2.8 | 0.04 |
| 4 | | 6.7 | 1.66 | 2.7 | 0.04 |
| 5 | | 13.3 | 1.29 | 2.5 | 0.04 |
| 6 | | 26.7 | 0.82 | 2.7 | 0.04 |
| 7 | (9) | 33.3 | 0.65 | 2.3 | 0.02 |

TABLE 1-continued

| Sample No. | Desensitiser Compound No. | Desensitiser (mg/mol of AgBr) | Sensitivity $S_{50}$* | Contrast $\gamma$ | $D_{min}$ |
|---|---|---|---|---|---|
| 8 | | 66.7 | 0.18 | 2.4 | 0.03 |
| 9 | | 133 | −0.26 | 2.2 | 0.03 |
| 10 | | 267 | −0.43 | 2.5 | 0.03 |
| 11 | | 400 | −0.28 | 2.6 | 0.02 |
| 12 | | 533 | −0.27 | 2.6 | 0.03 |
| 13 | | 667 | −0.25 | 2.9 | 0.03 |
| 14 | | 800 | −0.21 | 2.7 | 0.03 |

*lux. seconds at 50% of the maximum density; $S_{50}$ = 3-logE (E in lux.seconds)

The examples which follow show the desensitising effect of diverse halogenated trinuclear cyanines according to the present invention on photographic emulsions.

EXAMPLE 2

A cubic-monodisperse silver iodide/silver bromide emulsion in which the crystals have a mean edge length of 0.23$\mu$ and which contains 1.6 mol percent of silver iodide is chemically ripened in a manner identical to that used for the emulsion described in Example 1. The emulsion thus obtained is divided into 27 parts and methanolic solutions of the desensitisers of the formulae (11) and (12) are added in accordance with Table 2 below. The emulsions treated in this way are adjusted to a pH value of 5.5 and a pAg value of 8.2 and are then coated onto a polyester substrate in a layer thickness which corresponds to 2.0 g of silver and 2.5 g of gelatin per $m^2$. After drying, the samples are exposed to illumination of an intensity of 30,000 lux for as long as is necessary to form a latent image and are then developed in the same way as the samples of Example 1.

The sensitometric results obtained are listed in Table 2 which follows. The sensitivities $S_{50}$ can reach values of up to at most (−4).

TABLE 2

| Sample No. | Desensitiser Compound No. | Desensitiser (mg/mol of AgBr) | Sensitivity $S_{50}$* | Contrast $\gamma$ | $D_{min}$ |
|---|---|---|---|---|---|
| 15 | | — | 2.16 | 2.9 | 0.03 |
| 16 | | 0.7 | 1.68 | 2.5 | 0.03 |
| 17 | | 1.3 | 1.25 | 2.1 | 0.03 |
| 18 | | 3.3 | 0.68 | 2.1 | 0.03 |
| 19 | | 6.7 | 0.17 | 2.4 | 0.03 |
| 20 | | 13.3 | −0.37 | 2.6 | 0.01 |
| 21 | (11) | 33.3 | −0.96 | 3.0 | 0.01 |
| 22 | | 66.7 | −1.69 | 3.2 | 0.01 |
| 23 | | 133 | −2.18 | 2.5 | 0.01 |
| 24 | | 267 | −2.89 | 2.2 | 0.01 |
| 25 | | 467 | −3.22 | 2.1 | 0.02 |
| 26 | | 667 | −3.08 | 2.4 | 0.02 |
| 27 | | 800 | −3.17 | 2.1 | 0.03 |
| 28 | | 933 | −3.19 | 2.1 | 0.04 |
| 29 | | 0.7 | 1.87 | 2.4 | 0.01 |
| 30 | | 1.3 | 1.53 | 2.2 | 0.02 |
| 31 | | 3.3 | 0.98 | 2.1 | 0.01 |
| 32 | | 6.7 | 0.47 | 2.1 | 0.02 |
| 33 | | 13.3 | −0.10 | 2.4 | 0.01 |
| 34 | | 33.3 | −0.90 | 2.4 | 0.02 |
| 35 | (12) | 66.7 | −1.52 | 2.6 | 0.02 |
| 36 | | 133 | −2.47 | 2.9 | 0.02 |
| 37 | | 267 | −3.44 | 2.5 | 0.02 |
| 38 | | 467 | −3.56 | 2.6 | 0.02 |
| 39 | | 667 | −3.66 | 2.3 | 0.04 |
| 40 | | 800 | −3.42 | 2.7 | 0.05 |
| 41 | | 933 | −3.87 | about 2.5 | 0.06 |

*lux. seconds at 50% of the maximum density: $S_{50}$ = 3-logE (E in lux. seconds)

EXAMPLE 3

A silver iodide/silver bromide emulsion which is identical to that of Example 2 is divided into nine parts and diverse amounts of the halogenated trinuclear cyanine of the formula (14), dissolved in methanol, are added in accordance with Table 3 which follows. After adjusting the pH value to 5.0 and the pAg value to 8.2, the nine emulsion samples are coated onto a polyester substrate in the same way as described in Example 2.

After drying the samples, the latter are exposed in the same way as in Example 1. The following sensitometric values are obtained:

TABLE 3

| Sample No. | Cyanine of the formula (14) (mg/mol of AgBr) | Sensitivity $S_{50}$* | Contrast $\gamma$ | $D_{min}$ |
|---|---|---|---|---|
| 42 | 0 | 2.36 | 3.2 | 0.04 |
| 43 | 6.7 | 0.87 | 1.8 | 0.03 |
| 44 | 13.3 | 0.39 | 1.8 | 0.03 |
| 45 | 33.3 | −0.28 | 1.9 | 0.02 |
| 46 | 100 | −1.64 | 2.0 | 0.02 |
| 47 | 200 | −2.38 | 2.3 | 0.02 |
| 48 | 400 | −2.90 | 2.6 | 0.02 |
| 49 | 600 | −3.41 | 2.6 | 0.03 |
| 50 | 867 | −3.61 | 2.5 | 0.04 |

*lux. seconds at 50% of the maximum density: $S_{50}$ = 3-logE (E in lux. seconds)

EXAMPLE 4

A sulfur/gold-ripened silver iodide/silver bromide emulsion, which is identical to that of Example 2, is divided into 10 parts. Various amounts of the compound of the formula (13) in methanolic solution are added, in accordance with Table 4, to the 10 emulsion samples. The 10 samples are coated in the same way as the samples of Example 2 onto a polyester substrate.

After exposure and development as indicated in Example 2, the following sensitometric results are obtained:

TABLE 4

| Sample No. | Cyanine of the formula (13) (mg/mol of AgBr) | Sensitivity $S_{50}$* | Contrast $\gamma$ | $D_{min}$ |
|---|---|---|---|---|
| 51 | 0 | 2.43 | 2.8 | 0.02 |
| 52 | 3.3 | 0.86 | 1.6 | 0.02 |
| 53 | 6.7 | 0.29 | 1.5 | 0.01 |
| 54 | 13.3 | −0.61 | 1.8 | 0.02 |
| 55 | 33.3 | −1.31 | 2.1 | 0.02 |
| 56 | 100 | −2.07 | 2.8 | 0.02 |
| 57 | 200 | −2.60 | 3.1 | 0.02 |
| 58 | 400 | −3.06 | 3.0 | 0.02 |
| 59 | 600 | −3.00 | 3.0 | 0.02 |
| 60 | 867 | −2.88 | 2.0 | 0.03 |

*lux. seconds at 50% of the maximum density: $S_{50}$ = 3-logE (E in lux. seconds)

Examples 5 and 6, which follow, show how photographic, negative-working emulsions which are treated according to the invention with diverse densitisers in varying amounts can be used as materials which are stable to bright light. For this purpose, one piece of each sample is exposed to normal flash exposure and the sensitivity is determined, and a second piece is exposed for 10 minutes beneath a tungsten lamp with an illumination of 100 lux, corresponding to subdued filament lamp illumination, and the resulting fog is measured.

EXAMPLE 5

The samples used correspond to those designated with the same number in the preceding Examples 2 to 4. Their photographic sensitivity is determined by exposure to a BROWN F 700 Professional electronic flash (flash energy 120 Joules, reflector aperture 85°). The distance between the flash tube and the material is 58 cm. The same developer as in Example 1 is used.

Table 5, which follows, shows that all of the samples tested have a very high low-intensity reciprocity error. Consequently, with the intense flash exposure used, they are sufficiently sensitive for normal use. On the other hand, after 10 minutes exposure to 100 lux under a tungsten lamp only an insignificant fog is found. If exposure to subdued tungsten light is replaced by exposure to subdued daylight which is of corresponding energy but which also contains a slight proportion of UV light, virtually equivalent results are obtained.

TABLE 5

| Sample No. | Desensitiser Compound No. | Desensitiser (mg/mol of AgBr) | Sensitivity flash $S_{0.5}$** | Fog with 100 lux/ 10 minutes |
|---|---|---|---|---|
| 38 | (12) | 467 | −1.41 | 0.02 |
| 40 | (12) | 800 | −1.28 | 0.04 |
| 41 | (12) | 933 | −1.74 | 0.02 |
| 26 | (11) | 667 | −1.59 | 0.04 |
| 27 | (11) | 800 | −1.43 | 0.03 |
| 28 | (11) | 933 | −1.36 | 0.02 |
| 48 | (14) | 400 | −1.05 | 0.04 |
| 49 | (14) | 600 | −1.50 | 0.03 |
| 50 | (14) | 867 | −1.65 | 0.04 |
| 57 | (13) | 200 | −0.74 | 0.05 |
| 58 | (13) | 400 | −1.06 | 0.05 |
| 59 | (13) | 600 | −0.86 | 0.07 |
| 60 | (13) | 867 | −0.87 | 0.15 |

**lux. seconds at 0.5 optical density $S_{0.5}$ = 3-logE (E in lux seconds)

EXAMPLE 6

A silver iodide/silver bromide emulsion which is identical to that of Example 2 is divided into five equal parts to which various amounts of a methanolic solution of the compounds of the formula (9) or (10) are added in accordance with Table 6, which follows. After adjusting the pH value to 5.5 and the pAg value to 8.2, the emulsion samples are coated onto a polyester substrate in the manner described in Example 2.

The dried samples are exposed in the same way as in Example 5, using an electronic flash, and specifically one half of each sample is exposed using a KODAK WRATTEN No. 3 yellow gelatin filter and the other half is exposed without using this filter. One further sample in each case is exposed for 10 minutes to illumination of an intensity of 100 lux, using a tungsten filament lamp, an identical Kodak Wratten No. 3 filter being placed in front of the lamp. The same developer as in Example 1 is used for developing the samples.

TABLE 6

| Sample No. | Desensitiser Compound No. | Desensitiser (mg/mol of AgBr) | Sensitivity (flash) $S_{0.5}$ without filter | Sensitivity (flash) $S_{0.5}$ with Kodak 3 filter | Fog with 100 lux for 10 minutes Filter with Kodak 3 |
|---|---|---|---|---|---|
| 61 | (10) | 400 | −0.12 | −0.81 | 0.09 |
| 62 | (10) | 800 | −0.19 | −1.06 | 0.06 |
| 63 | (9) | 200 | −0.43 | −1.13 | 0.04 |
| 64 | (9) | 400 | −0.90 | −1.39 | 0.04 |

TABLE 6-continued

| Sample No. | Desensitiser Compound No. | Desensitiser (mg/mol of AgBr) | Sensitivity (flash) $S_{0.5}$ without filter | Sensitivity (flash) $S_{0.5}$ with Kodak 3 filter | Fog with 100 lux for 10 minutes Filter with Kodak 3 |
|---|---|---|---|---|---|
| 65 | (9) | 800 | −0.78 | −1.59 | 0.02 |

The above table shows that the stability in lit working rooms is sufficient if the tungsten lamp used for exposure is likewise screened by a yellow Kodak Wratten No. 3 filter. Moreover, the sensitivity on flash exposure is still sufficiently high, even in the presence of a Kodak Wratten No. 3 filter.

Under the conditions employed in Example 5 (100 lux/10 minutes, white light), the non-halogenated trinuclear cyanines of the formulae (9) and (10) which are used in this example do not give adequate stability or give too great a fog.

What is claimed is:

1. A photographic negative silver halide material with at least one layer which contains a desensitised silver halide emulsion, wherein this layer contains, as the desensitiser, a trinuclear heptamethinecyanine or a methine halogenated trinuclear tetramethinecyanine with each having three identical heterocyclic ring systems, which can have different substituents and are linked to one another by three identical methine systems, which can be mesomeric.

2. A photographic material according to claim 1, wherein the desensitiser has one of the formulae

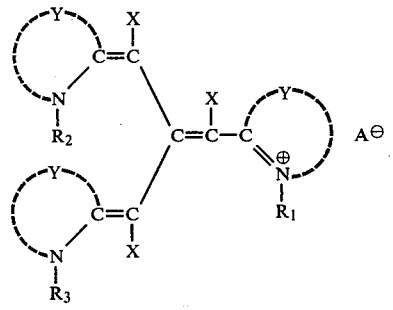

(1)

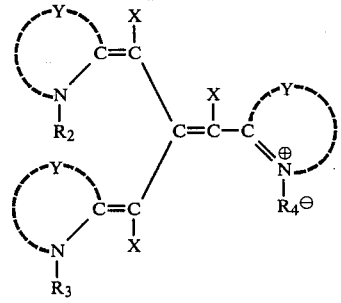

(2)

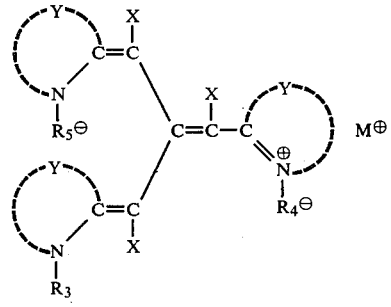

(3)

-continued or (4)

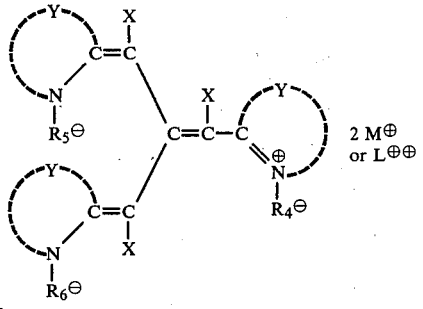

(5)

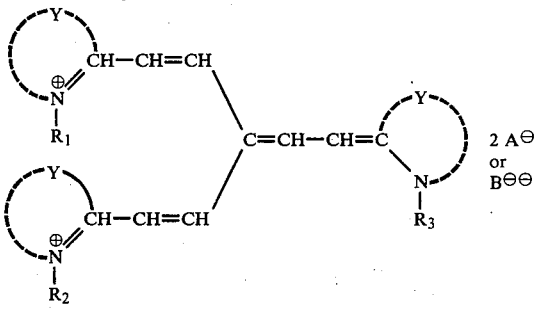

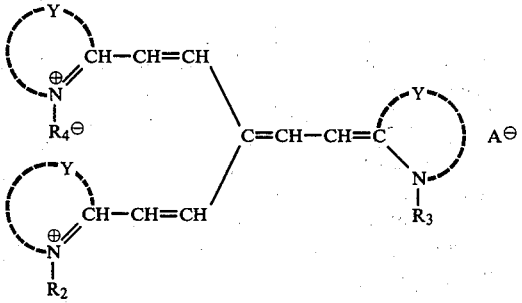

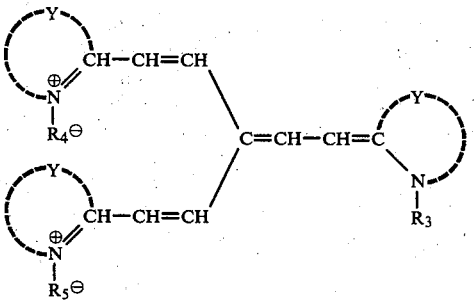

or (8)

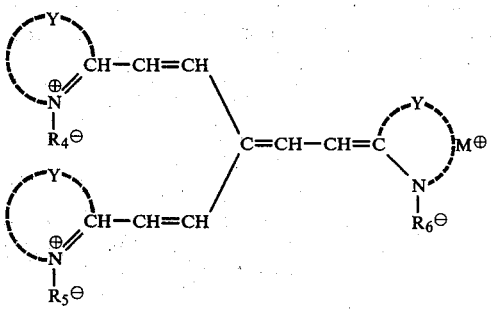

in which Y is the atoms required to complete a mono- or poly-heterocyclic ring system, $R_1$, $R_2$ and $R_3$ are each alkyl having 1 to 20 carbon atoms or alkenyl having 2 to 20 carbon atoms, preferably alkyl or alkenyl having 1 (2) to 4 carbon atoms in the main chain, the said radicals being unsubstituted or substituted by halogen, hydroxyl, cyano, alkoxy having 1 to 4 carbon atoms or carbalkoxy having 1 to 4 carbon atoms in the alkoxy radical, or are each aryl or aralkyl, which are unsubstituted or substituted by halogen, hydroxyl, cyano, alkoxy having 1 to 4 carbon atoms, carbalkoxy having 1 to 4 carbon atoms in the alkoxy radical, alkyl, hydroxyalkyl or halogenoalkyl having 1 to 4 carbon atoms, or mono- or di-alkylamino, amino, carboxamido or sulfonamido groups, $R_4$, $R_5$ and $R_6$ are each alkyl or alkenyl having 1 (2) to 20 carbon atoms, aryl, preferably phenyl, or aralkyl, preferably benzyl or phenylethyl, which are substituted by a carboxyl or sulfo group, X is hydrogen, fluorine, chlorine, bromine or iodine, at least one radical X being halogen, $A^{\ominus}$ is a monovalent anion and $M^{\oplus}$ is a monovalent cation, $L^{\oplus\oplus}$ is a divalent cation and $B^{\ominus\ominus}$ is a divalent anion.

3. A photographic material according to claim 2, wherein the heterocyclic ring system has one of the formulae (6)

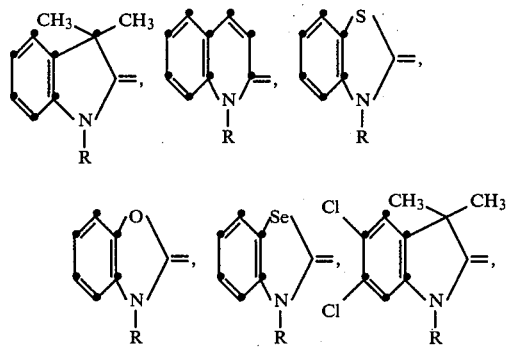

(7)

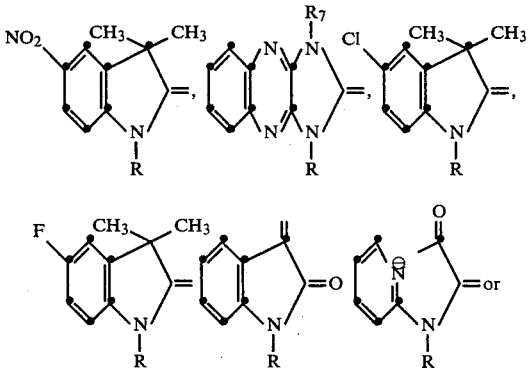

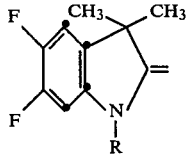

in which R is one of the radicals $R_1$ to $R_6$ defined in claim 2 and $R_7$ is alkyl having 1 to 4 carbon atoms.

4. A photographic material according to claim 2, wherein $R_1$, $R_2$ and $R_3$ are each methyl, ethyl, n-propyl, i-propyl, n-butyl, i-butyl, allyl, methallyl, β-methoxyethyl, β-ethoxyethyl, β-hydroxyethyl, γ-hydroxypropyl, phenyl, benzyl or β-phenylethyl and $R_4$, $R_5$ and $R_6$ are each carboxymethyl, carboxyethyl, carboxypropyl, carboxybutyl, sulfoethyl, sulfopropyl, sulfobutyl, p-sulfobenzyl, carboxy-methyl or -ethyl or carboxymethoxymethyl or -ethyl.

5. A photographic material according to claim 4, wherein the desensitiser is a trinuclear cyanine dye of the formula (9)

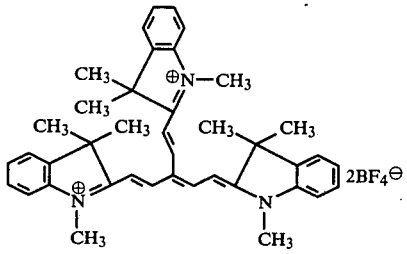

(10)

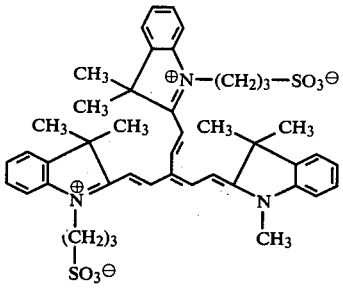

(11)

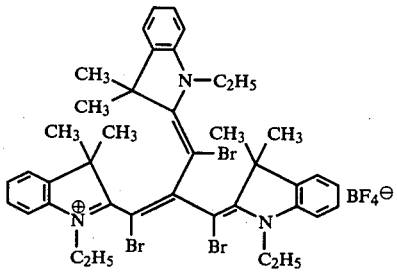

(12)

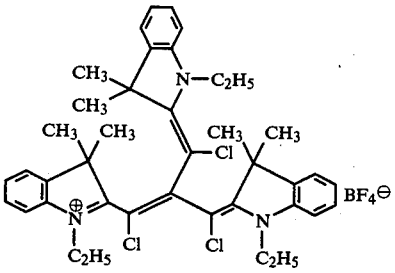

-continued (13)

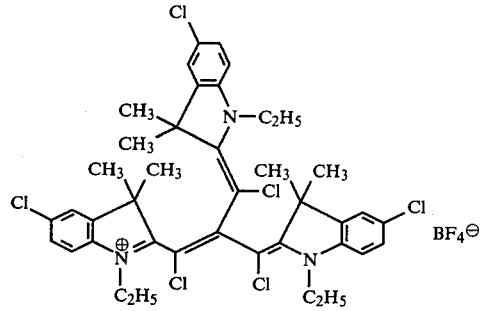

or (14)

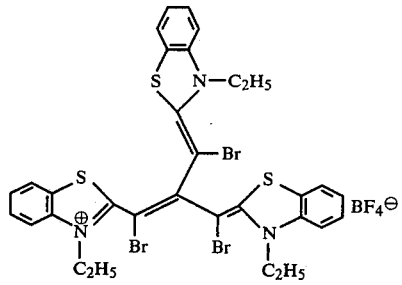

6. A photographic material according to claim 1, wherein the emulsion containing the desensitiser has been desensitised by a factor of at least 300 (logE=2.5).

7. A photographic material according to claim 1, which possesses a substantially higher sensitivity under illumination of high intensity than under illumination of lower intensity.

8. A photographic material according to claim 6, which after exposure for 10 minutes to yellow light with an intensity of illumination of 100 lux and subsequent silver developing has a density of less than 0.1.

9. A photographic material according to claim 1, wherein the desensitised silver halide emulsion contains 20 to 1,000 mg of a desensitiser per mol of silver halide.

10. A process for the preparation of the photographic negative silver halide material according to claim 1, which comprises incorporating a trinuclear heptamethinecyanine or a methine halogenated trinuclear tetramethinecyanine each of which has three identical heterocyclic ring systems, which can have different substituents and are linked to one another by three identical methine systems, which can be mesomeric, as the desensitiser into at least one silver halide emulsion layer.

11. A process for the production of photographic images which comprises exposing and then developing, bleaching and fixing the photographic material according to claim 1.

* * * * *